US005303644A

United States Patent [19]

Held

[11] Patent Number: 5,303,644

[45] Date of Patent: Apr. 19, 1994

[54] CONTINUOUSLY OPERATING DOUBLE BAND PRESS WITH A SHAPE COMPENSATING PLATE STRUCTURE INCLUDING A DEFORMATION-LIMITING SUPPORTING PLATE

[76] Inventor: Kurt Held, Alte Strasse 1, D-7218 Trossingen 2, Fed. Rep. of Germany

[21] Appl. No.: 935,092

[22] Filed: Aug. 25, 1992

[30] Foreign Application Priority Data

Aug. 23, 1991 [DE] Fed. Rep. of Germany ..... 4128024

[51] Int. Cl.[5] ..... B30B 5/06; B30B 15/34

[52] U.S. Cl. ..... 100/93 P; 100/154; 100/269 A; 100/295; 156/555; 156/583.5; 165/45; 425/371

[58] Field of Search ..... 100/93 P, 93 RP, 151, 100/154, 269 A, 295; 156/555, 583.5, 145; 165/46, 86; 425/371

[56] References Cited

U.S. PATENT DOCUMENTS

| | | | |
|---|---|---|---|
| 2,142,932 | 1/1939 | Beard | 100/93 RP |
| 3,216,493 | 11/1965 | Maginn | 165/46 X |
| 3,434,910 | 3/1969 | Kannegiesser et al. | 100/93 P X |
| 3,619,310 | 11/1971 | Clarke | 100/93 P X |
| 3,817,803 | 6/1974 | Horsky | 156/145 X |
| 4,156,589 | 5/1979 | Schmitt et al. | 100/211 X |
| 4,190,484 | 2/1980 | Pohl | 100/269 A X |
| 4,247,963 | 2/1981 | Reddi | 156/145 X |
| 4,311,550 | 1/1982 | Kerttula | 100/93 RP X |
| 4,485,733 | 12/1984 | Held | 100/154 X |
| 4,557,792 | 12/1985 | Yamada et al. | 100/93 P X |
| 4,723,484 | 2/1988 | Held | 100/93 P X |
| 4,816,114 | 3/1989 | Held | 100/154 X |

FOREIGN PATENT DOCUMENTS

| | | | |
|---|---|---|---|
| 1963806 | 6/1971 | Fed. Rep. of Germany | 100/93 RP |
| 2722197 | 10/1978 | Fed. Rep. of Germany . | |
| 3123291 | 1/1983 | Fed. Rep. of Germany . | |
| 3304754 | 9/1983 | Fed. Rep. of Germany . | |
| 53-10673 | 1/1978 | Japan | 425/371 |

*Primary Examiner*—Stephen F. Gerrity
*Attorney, Agent, or Firm*—Klaus J. Bach

[57] ABSTRACT

A continuously operating double band press for the production of material webs, a shape compensating plate and a discontinuously operating single or multiple-platen press for the production of materials in portions is disclosed. Shape compensating plates are arranged in the press frame of the double band press or at the pressing plates of the platen press. The shape compensating plate comprises two plates of metal which are parallel arranged. An elastic bellows serving as a lateral seal is fastened at its edge to extend annularly. The chamber formed by the plates and the elastic bellows is filled with a fluid medium.

27 Claims, 8 Drawing Sheets

CONTINUOUSLY OPERATING DOUBLE BAND PRESS WITH A SHAPE COMPENSATING PLATE STRUCTURE INCLUDING A DEFORMATION-LIMITING SUPPORTING PLATE

FIELD OF THE INVENTION

The present invention is directed to pressing apparatuses and more particularly to an operating double band press with a shape compensating plate structure including a deformation-limiting supporting plate for the production of endless material webs such as laminates, chipboards or fiberboards, plywood or the like.

BACKGROUND OF THE INVENTION

Double band presses may be used for the continuous production of endless web-shaped work materials, particularly for the production of decorative laminated materials, copper-lined electrolaminates, thermoplastic webs, chipboards, fiberboards and the like. These double band presses may comprise two continuous circumferentially extending press bands between which the material web is cured under pressure and possibly heated while being transported in the feed direction. Pressure plates in the press frame of the double band press produce the area pressure transmitted from the pressure plates to the inner sides of the press bands and from the press bands to the work material web.

Two different working principles for transmitting the pressure from the pressure plate to the inner side of the press band involve the isobaric and isochoric machines. In isobaric machines (see, e.g. DE-PS 27 22 197), annularly self-contained sliding-surface or packing or floating seals are arranged along an edge of the pressure plate and placed against the press band so that the press band slides during the operation of the double band press. Pressure chambers are thereby formed which are defined, in the vertical direction, by the pressure plate and by the inner side of the press band and, in the horizontal direction, by the floating seals. A fluid pressure medium, e.g. oil or compressed air, is introduced into these pressure plates.

In isochoric machines, the pressure is mechanically transmitted via rolls, from the pressure plate to the inner side of the press band. A stationary roll bed arranged in the pressure plate is known from DE-OS 31 23 291. The roll bed comprises rolls which are offset relative to one another and supported by shafts in bearing strips which are fastened in the pressure plate.

DE-OS 33 04 754 discloses a double band press which combines the isobaric and isochoric principles. A roll bed is arranged in a pressure cushion which is sealed at the sides by floating seals. This press can be operated in a purely isochoric manner in that only the roll bed is placed against the press band without introducing a fluid pressure medium under pressure into the pressure cushion. A purely isobaric operation is also possible in that the roll bed is not placed against the press band and only a fluid pressure medium maintains the pressure in the pressure cushion. In the combined isobaric/isochoric type of operation, the roll bed is placed against the press band and a fluid pressure medium is introduced into the pressure cushion. In this double band press, an additional pressure chamber is used for exerting a pressure on the roll bed. This pressure chamber is arranged at the side of the pressure plate remote of the press band and is defined in the vertical direction by the pressure plate and by a closure located in the press frame and in the horizontal direction by lateral seals which are constructed identically to the floating seals for the pressure cushion. The pressure plate and the roll bed located in the pressure plate are placed against the press band by introducing a fluid pressure medium into this pressure chamber.

Unfortunately, however, when such double band presses are operated in the combined isobaric/isochoric operation, a leakage of fluid pressure medium can occur at the lateral seals of the pressure chamber at the side of the pressure plate remote of the press band, particularly at higher pressures. Furthermore, the press frame and material to be pressed can be soiled and often requires treatment when pressing at increased temperature. The pressure plate is heated to the required temperature for this purpose.

Sealing materials for lateral seals comprise plastic or elastomers which can resist temperatures up to only about 270° C. The lateral seals of this pressure chamber are therefore destroyed at higher temperatures, leading ultimately to a failure of the pressure chamber to apply pressure and to a time-consuming and costly repair of the double band press. Such double band presses are consequently not suitable for use at higher temperatures.

To overcome these and other drawbacks of previously known presses, it is an object of the invention to develop an isochoric or combined isochoric/isobaric double band press to operate reliably at increased temperatures.

Another object of the invention is to provide a press in which no leakage of pressure medium can occur in the shape compensating plate due to a hermetic lateral edge seal.

A further object of the invention is to provide a press in which soiling of the press and material to be pressed is reliably prevented.

Another object of the invention is to provide a double band press with a shape compensating plate in which there is much less waste of the material to be pressed than in previous double band presses.

Yet another object of the invention is to provide a double band press in which the shape compensating plate contains no plastic, so that the double band press can also be used for high temperatures.

Still another object of the invention is to provide a double band press which compensates for bending in the pressing region of the press, particularly bending of the press frame by a shape compensating plate so that a product with improved dimensional stability is produced on the double band press.

A still further object of the invention is to provide a press having a good thermal fluid pressure medium in a shape compensating plate, using, for example, metallic fluids which demonstrates good thermal conductivity so that an unimpeded transfer of heat is ensured between the press bands and a heat exchanging plate in a plane-parallel manner in the press frame.

Yet another object of the invention is to provide a double band press in which material of different widths to be processed by using a shape compensating plate divided into a plurality of individual strip-shaped shape compensating plates arranged adjacent to one another.

Additionally, it is an object of the invention to provide a double band press comprising a shape compensating plate which can be used not only in continuously operating double band presses, but also in discontinuously operating single or multiple-platen presses.

SUMMARY OF THE INVENTION

These and other objects of the invention, which shall become apparent hereafter are achieved by a continuously operating double band press for the production of material webs, a shape compensating plate and a single or multiple-platen press for the production of materials in portions. The shape compensation plates are arranged in the press frame of the double band press or at the pressing plates of a platen press and comprises two plates of metal which are substantially parallel and joined preferably by an elastic bellows which serves as a lateral seal fastened at its edge to extend annularly forming a chamber which may be filled with a fluid medium and which includes a deformation-limiting supporting plate.

BRIEF DESCRIPTION OF THE DRAWINGS

The invention will be better understood by the Detailed Description of the Preferred Embodiments, in connection with the drawings of which

DETAILED PRESCRIPTION OF THE PREFERRED EMBODIMENT

Figure 1:
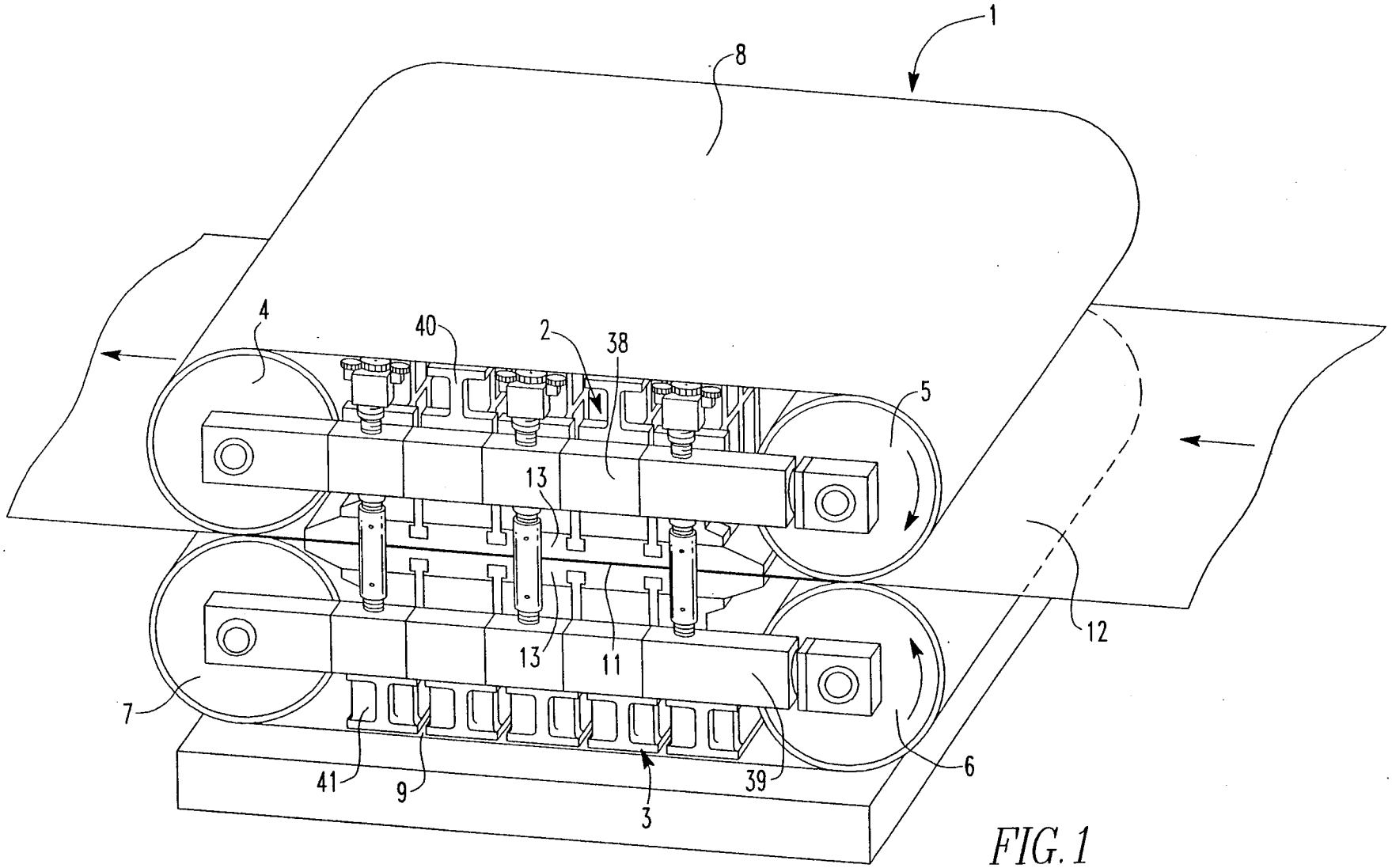
FIG. 1 is a side perspective view of a double band press.
Figure 2:
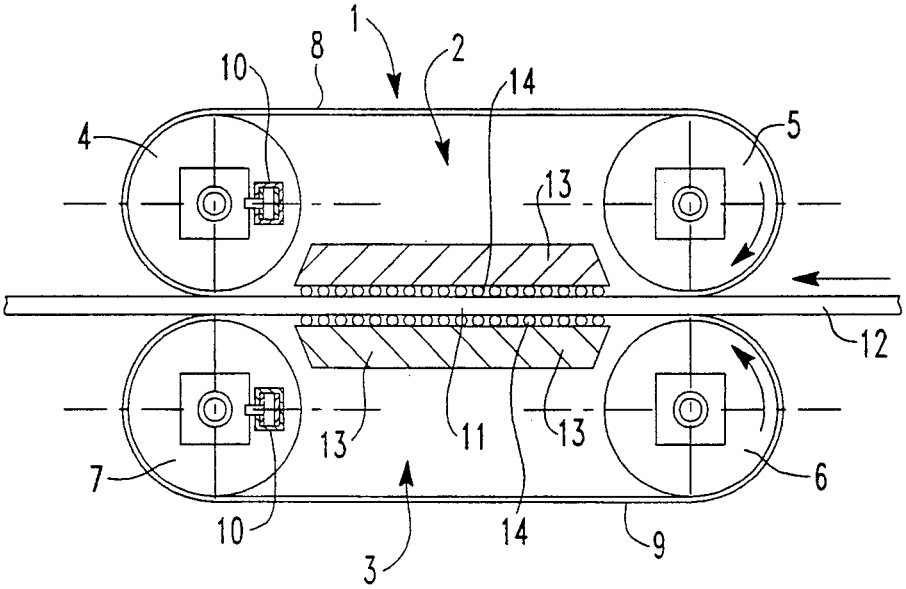
FIG. 2 is a schematic side view of a double band press in longitudinal section.

Referring now to the drawings, wherein like numerals reflect like elements throughout the several views, FIG. 1 is a perspective view of a continuously operating double band press 1 comprising an upper press band unit 2 and a lower press band unit 3. Each unit 2, 3 comprises two deflecting rollers or reversing drums 4, 5 and 6, 7 which are rotatably supported in respective bearing blocks 38, 39 and are circumscribed by endless press bands 8, 9. The press bands 8, 9 comprise a high-tensile steel belt guided around the reversing drums 4, 5 and 6, 7 respectively and tensioned by hydraulic cylinders 10 in the bearing blocks 38, 39. At least one reversing drum of every press band unit 2, 3 is driven by a motor so that the two press bands 8, 9 move corresponding to the arrows in the reversing drums 5, 6. The bearing blocks 38, 39 are fastened at the press frame 40, 41 in FIG. 1, but which is not shown in FIG. 2 for clarity.

Element 11 represents a reaction zone between the lower band portion of the upper press band 8 located between the drums and the upper band portion of the lower press band 9 located between the drums. The material web 12 running in the reaction zone 11 from right to left, as shown, is pressed under the influence of area pressure while passing through the double band press 1. Pressure plates 13 are arranged in the press frame 40, 41 of the double band press 1 for generating the area pressure acting on the material web 12 in the reaction zone 11. The area pressure is applied by the pressure plates 13 to the inner sides of the press bands 8, 9 and then transmitted from the pressure plates to the material band 12. This is an isochoric double band press. A roll bed comprising stationary rolls 14 generates the mechanical area pressure between the pressure plate 13 and the inner side of the press band 8, 9.

Figure 3:
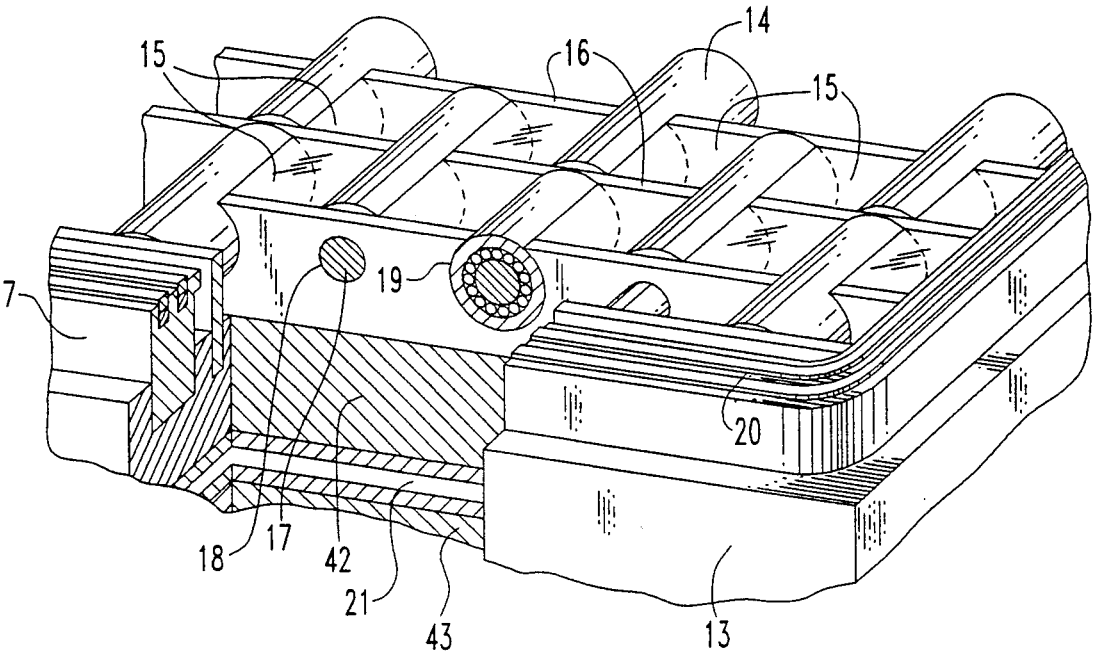
FIG. 3 is a perspective view of a roll bed.

A roll bed for mechanical transmission of pressure is depicted in perspective view in more detail in FIG. 3. Supporting bearing strips 16 are arranged in the pressure plate 13 in the longitudinal direction of the pressure plate 13, i.e. in the forward feed direction of the press band 8, 9. Supporting shafts 17 on which the rolls 14 are arranged in rows parallel to the forward feed direction of the press bands 8, 9 are located in these supporting bearing strips 16. The length of the rolls 14 is less than the width of the pressure plate 13 so that a plurality of rolls 14 are arranged adjacent to one another on a supporting shaft 17. The rolls 14 are offset relative to one another by half the width of a roll in two adjacent rows in each instance in that every second supporting bearing bore hole 18 is replaced by an opening 19 which is slightly greater than the diameter of the roll 14.

The roll bed can be enclosed by one or more floating seals 20 in the pressure plate 13 and placed against the press band 8, 9 by one surface, so that the press band 8, 9 slides along these floating seals 20. The floating seal 20 is annularly self-contained so that the roll bed lies within a sealed space and can be filled with lubricant for the rolls. The hollow space between two rolls 14 can be provided with a filling body 15 in order to improve the lubrication by forming capillary gaps between the roll 14, the supporting bearing strips 16 and the pressure plate 13. The space enclosed by the floating seal 20 can also be provided with a fluid pressure medium which additionally exerts a hydraulic pressure on the inner side of the press bands 8, 9. Such a construction is a double band press working in combined isobaric/isochoric operation.

Figure 4:
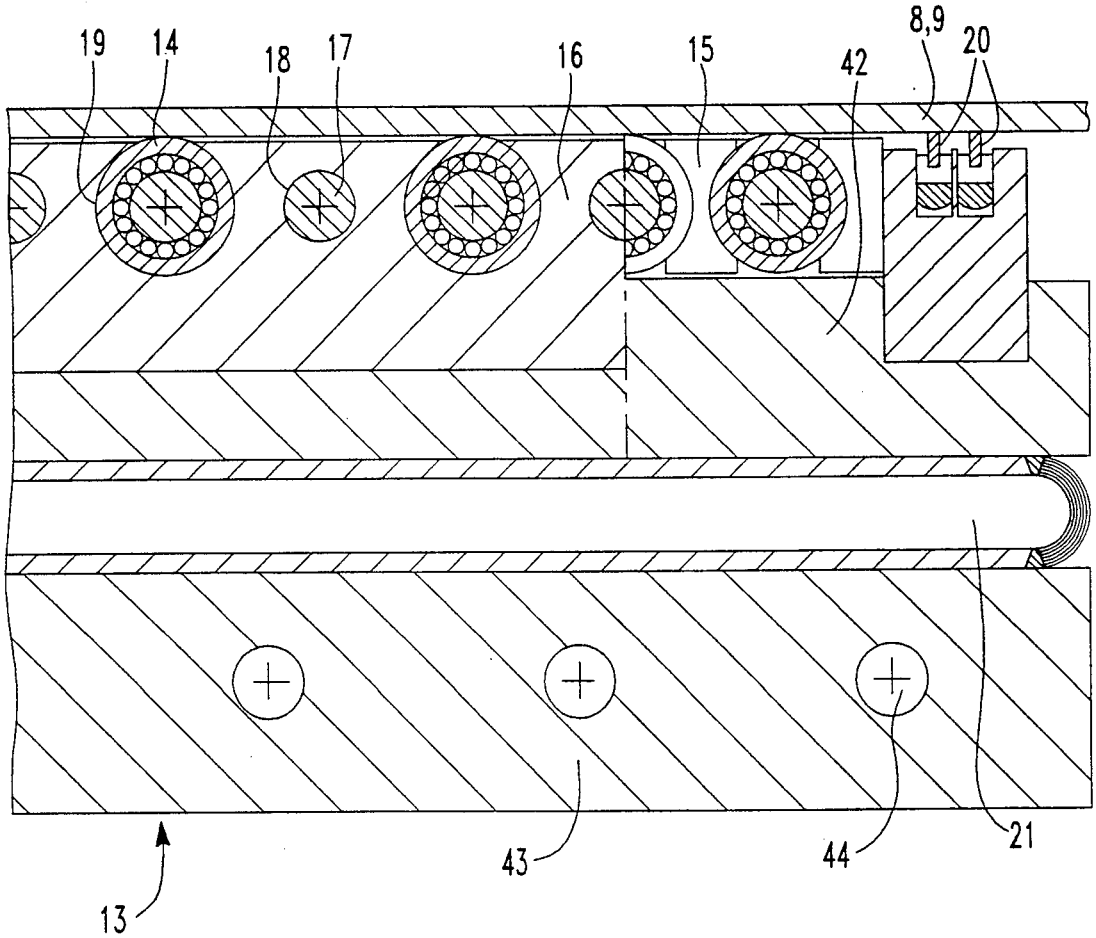
FIG. 4 is a sectional side view through the pressure plate in the longitudinal direction.

The reaction forces exerted by the material web 12 as a result of the acting area pressure are received by the pressure plate 13 and introduced into the press frame 40, 41. The pressure plate 13, seen in more detail in FIG. 4, comprises a carrier plate 42 in which the supporting bearing strips 16 for the roll bed are fastened, a shape compensating plate 21 adjoining the latter and a rigid heat exchanging plate 43. The carrier plate 42 is preferably constructed in a flexible manner. Bore holes 44 through which a fluid heat carrier medium can flow are located in the heat exchanging plate 43. The heat exchanging plate 43 can be heated or cooled so that heat can be supplied or carried off via shape compensating plate 21, the carrier plate 42 and the press band 8, 9 of the material web 12.

The heat exchange takes place in the carrier plate 42 or in the roll bed. Heat exchanging plate 43 can be dispensed with and the shape compensating plate 21 can be arranged directly on the press frame 40, 41. Such heat exchange can be achieved in that the heated or cooled pressure medium located in the space between the floating seals 20 is supplied or carried off in circulation so that heat can be exchanged between the press band 8, 9 and the pressure medium by means of convection due to the flow.

Figure 5:
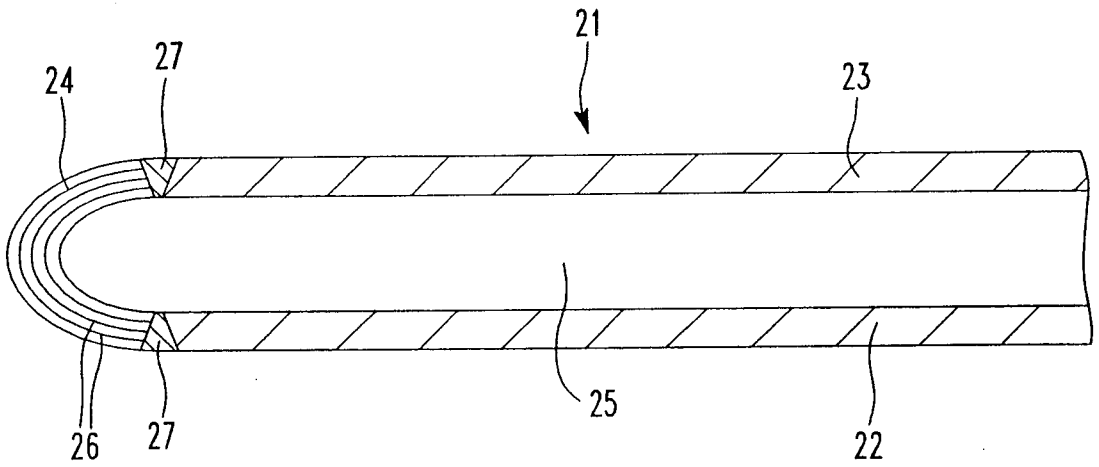
FIG. 5 is a sectional side view through the shape compensating plate.

The shape compensating plate 21 which is arranged at the rear of the carrier plate 42, i.e. on the side of the roll bed remote of the press band 8, 9, comprises two plates, a base plate 22 and a cover plate parallel arranged at a certain distance from one another as seen in FIG. 5. The base and cover plates 22, 23 comprise metal, e.g. steel. An elastic bellows 24 is fastened at the base plate 22 by one end and at the cover plate 23 by the other end and extends angularly along the edge of the base plate 22 and cover plate 23. A chamber 25 hermetically sealed laterally by an elastic bellows 24 is formed between the base plate 22 and the cover plate 23. A fluid pressure medium which is under pressure is located in this outwardly sealed chamber 25. This fluid can be a liquid under pressure, e.g. oil, but can also be a gas under pressure into this chamber 25. A metallic fluid such as mercury or wood metal is particularly preferred. Wood metal is an alloy of bismuth, lead, tin and cadmium having a low melting point. In the event that the material web 12 to be pressed is heated in the double band press 1, simultaneously accompanied by the application of pressure, it is also possible to select an alloy or metal as contents for the chamber 25 which is fusible at the temperature to which the heat exchanging plate 43 is heated, e.g. tin. The fluid pressure medium is reliably prevented from leaking out of the shape compensating plate 21 due to the hermetic sealing by the elastic bellows 24.

The elastic bellows 24 which laterally encloses the chamber 25 has an approximately semicircular cross section and comprises rectangular metal foils or plates 26 which are placed on top of one another individually. The individual layers of metal foils or plates 26 are welded to form rings. A high-tensile spring steel or high-grade steel is suitable as material for these plates. This plate ring packet is semicircular to U-shaped in cross section, as seen in FIG. 5 and is welded together at the edges. This construction provides the plate packet high elasticity. The plate packet is subsequently placed against the base plate 22 by one end and against the cover plate 23 by the other end and is bent in a circular manner at the corners of the plates 22, 23 by approximately 90° to form a U-shaped quarter bend. Finally, the ends of the plate packet containing the plates 22, 23 are fastened at the plates 22, 23. This fastening can be achieved by a weld seam. The individual metal foils or plates 26 can also comprise electro-formed parts which are galvanically deposited in the desired semicircular shape and are then welded together at the edges 27. The work step of bending the plate packet to form the semicircular shape can accordingly be dispensed.

The area pressure exerted by the pressure plate 13 fastened in the press frame 40, 41 acts on the material web 12 via the roll bed and the press bands 8, 9. In an isobaric/isochoric double band press, an additional hydraulic pressure acts on the material web 12 from the fluid pressure medium located in the space between the floating seals 20. Because of the pressing pressure which is exerted, reaction forces introduced into the pressure plate 13 via the roll bed proceed from the material web 12 and are absorbed by the press frame 40, 41 in which the pressure plate 13 is fastened. In previous double band presses, bending of the roll bed, pressure plate 13 and press frame 40, 41 could come about as a result of these reaction forces and due to discontinuities and thickness tolerances in the material web 12 and press bands 8, 9, particularly at higher pressures, ultimately resulting in a material web 12 of unstable dimensions.

The pressure plate 13 comprises a carrier plate 42 and the shape compensating plate 21. If bending occurs in the roll bed or in the press frame 40, 41 it is counteracted by the isobaric pressure ratio of the fluid pressure medium located in the chamber 25 of the shape compensating plate 21. This counteracting is reinforced by the flexibility of the carrier plate 42. Bending of the roll bed, which is fastened at the carrier plate 42 by the supporting bearing strips 16, compensated for immediately by the action of the shape compensating plate 21 so that the dimensional stability of the thickness of the material web 12 is ensured within tolerances which could not previously be realized by isochoric or isochoric/isobaric double band presses.

As explained, the shape compensating plate 21 comprises metallic work materials which are also resistant to increased temperatures. The double band press 1, outfitted with the shape compensating plate 21, can accordingly operate reliably when used at increased temperatures.

Figure 6:
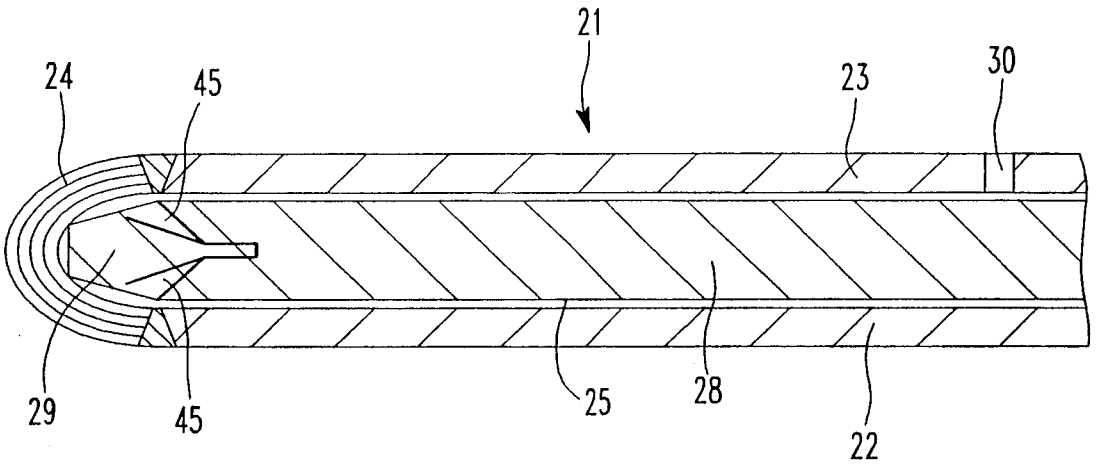
FIG. 6 is a sectional side view of another embodiment of a shape compensating plate.

At very high pressures, there is a risk that the elastic bellows 24 can be impermissibly deformed by the reaction forces. To counteract this risk, a supporting plate 28 can be arranged in the chamber 25 to support it, as shown in FIG. 6. The supporting plate 28 is substantially parallel to the base plate 22 and cover plate 23. The edge area 29 of the supporting plate 28 is slightly beveled and arranged in the inner curvature of the bellows 24 so that the bellows 24 is supported at the side facing the chamber 25 by the beveled edge area 29. Particularly high reaction forces acting on the elastic bellows 24 are then absorbed by the supporting plate 28. The supporting plate 28 can comprise copper so that a good thermal conductivity is also ensured in the chamber 25. This may be necessary particularly when the metal selected as fluid pressure medium in the chamber 25 is fusible at the operating temperature of the double band press 1 or when particularly large quantities of heat are transmitted between the heat exchanging plate 43 and the press band 8, 9. If an increased elasticity of the beveled edge area 29 of the supporting plate 28 is desired, notches 45 can be inserted in the beveled edge area 29.

Another embodiment form of the shape compensating plate 21 is seen in FIG. 6. In this embodiment, a bore hole 30 is arranged in the upper cover plate 23. The fluid pressure medium can be fed into the chamber 25 through this bore hole 30 so that the pressure can be varied in the chamber 25 in an advantageous manner. The shape compensating plate 21 need only be filled with the fluid pressure medium when it is actually needed. Consequently, a connectable and disconnectable shape compensating plate 21 can be realized with such an embodiment form.

Multiple-format double band presses can also be realized with the shape compensating plate 21. Since the press bands 8, 9, to which pressure is applied in the reaction zones 11, are supported against the material web 12, this material web 12 extends over the entire width of the reaction zone 11 in conventional double band presses. The shape compensating plate can be divided into a plurality of strips extending in the longitudinal direction and lying next to one another in the transverse direction so that narrower material webs 12 can also be used, wherein each strip is constructed as a separate self-contained shape compensating plate. If desired, every strip-shaped shape compensating plate can also be constructed so as to be separately connectable and disconnectable.

Figure 7:
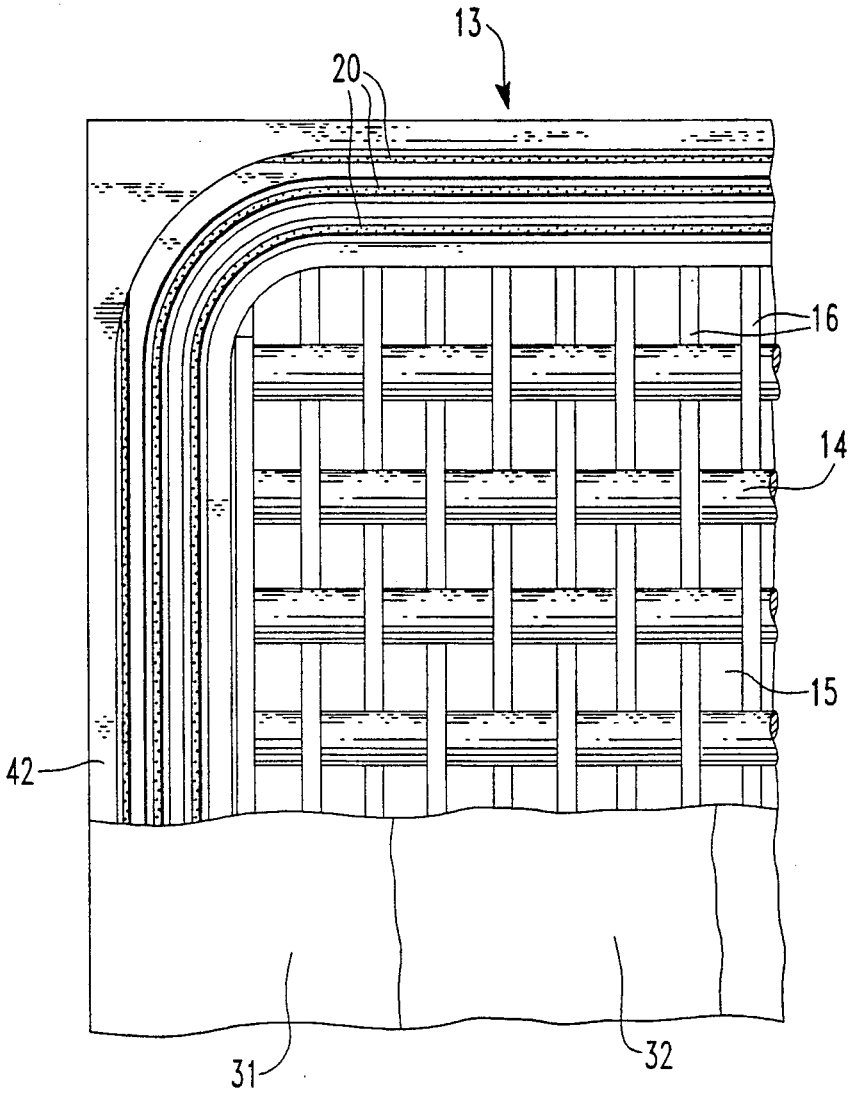
FIG. 7 is a bottom view of a strip-shaped arrangement of a plurality of shape compensating plates.

Such a strip-shaped arrangement of a plurality of shape compensating plates 31, 32 can be seen in FIG. 7, in which the pressure plate 13, including the roll bed, is shown in a top view, wherein the carrier plate 42 is omitted in part to expose the shape compensating plates 31, 32 below it. These strip-shaped shape compensating plates 31, 32, in desired width and quantity, are arranged in the pressure plate 13. The width of the material web 12 is then selected in such a way that it is covered precisely by one or more shape compensating plates 31, 32. Bending is accordingly compensated for precisely at those locations in the roll bed where the material web is acted upon by pressure so that a material web 12 lying within the thickness tolerances is ultimately produced in turn.

Figure 8:
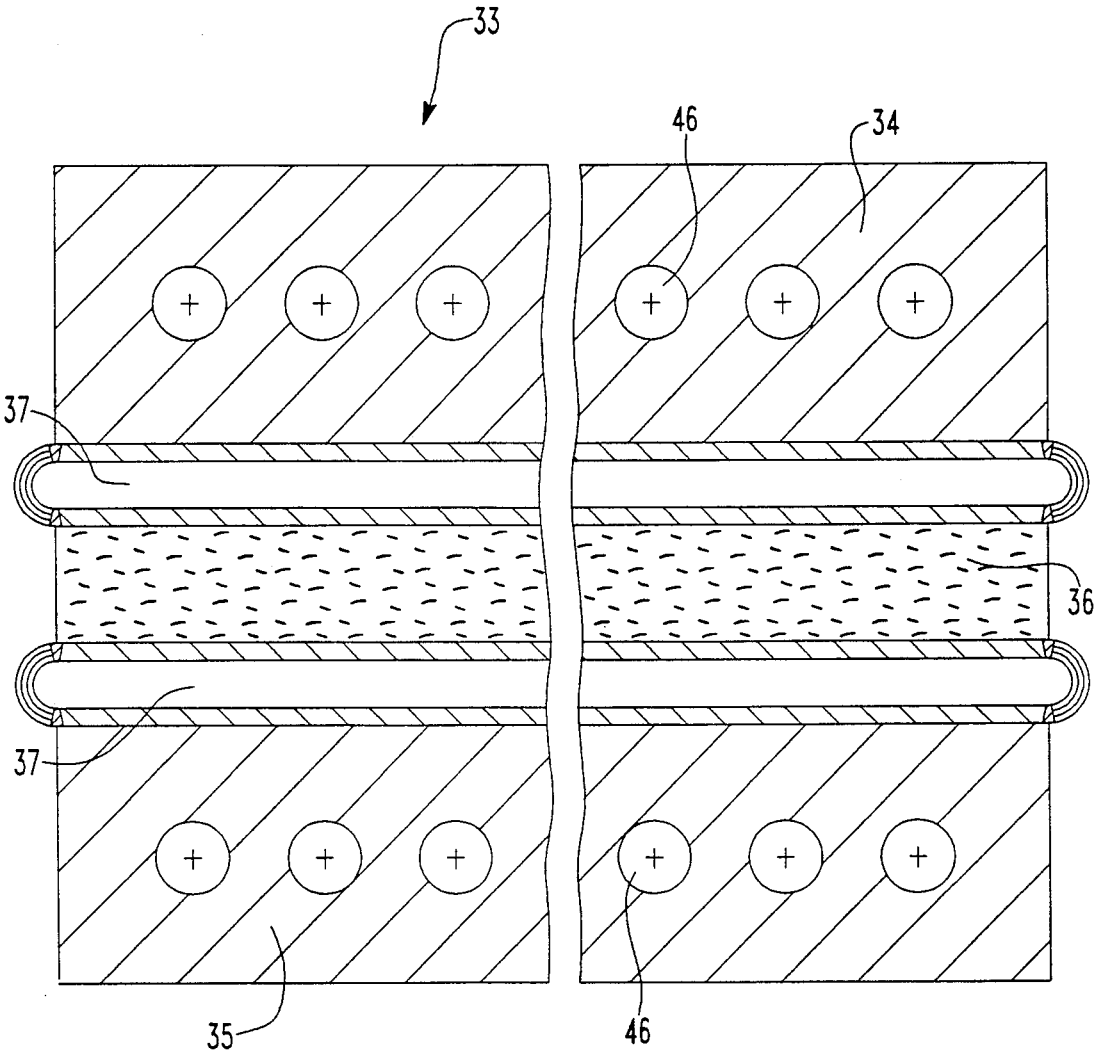
FIG. 8 is a sectional side view of a platen press.

The shape compensating plate can be used, not only in a continuously operating double band press, but also in a discontinuously operating platen press 33, as schematically depicted in FIG. 8. The material 36 to be pressed is compressed between two pressing plates 34 and 35 in the platen press 33. The pressing plates 34, 35 have bore holes 46 through which a heat carrier medium can be guided so that it can be heated or cooled. Local pressure differences can also occur as a result of discontinuities and thickness tolerances in the material 36 to be pressed and in the pressing plates 34, 35 and also as a result of deformations in the press yoke and press table caused by receiving loads. These local pressure differences can cause a warping of the pressing plates 34, 35 which ultimately leads to differences in the thickness of the material 36 to be pressed and accordingly to waste. Such a warping of the pressing plates 34, 35 is prevented in that the shape compensating plate 37 is fastened at the pressing plates 34, 35 at the side facing the material 36 to be pressed. In this case, a carrier plate can be dispensed with, i.e. the shape compensating plate 27 can directly contact the material 36 to be pressed. The shape compensating plate 37 is constructed corresponding to the preceding embodiment examples and absorbs local pressure differences from the material 36 to be pressed, so that a twisting or warping of the pressing plates 34, 35 is avoided and a pressed-material 36 is produced which lies within the desired thickness tolerances.

The shape compensating plate 37 can be used not only in single-platen presses, but also in multiple-platen presses. This is effected in the same way as with the single-platen presses, i.e. it is arranged between the material to be pressed and the pressing plate.

It is generally not absolutely necessary to fasten the shape compensating plate 37 to the pressure plates 34, 35; it is sufficient to place the shape compensating plates 37 in the press 33 between the pressing plate 34, 35 and the material 36 to be pressed. When using the shape compensating plates 37, the press cushion which was previously conventional in single and multiple-platen presses and was destroyed after a few pressing cycles and was therefore to be thrown away, can be replaced by the permanent shape compensating plate 37.

While the preferred embodiments of the invention have been depicted in detail, modifications and adaptations thereto may be made without departing from the spirit and scope of the invention, as defined by the following claims.

What is claimed is:

1. A continuously operating double band press for the production of endless material webs including laminates, chipboards, fiberboards and plywood, comprising:

a rigid press frame;

two sets of bearing blocks on the press frame two sets of reversing drums rotatably supported on the bearing blocks of the press frame;

an upper and a lower endless press band each guided over a set of said reversing drums arranged such that said press bands have opposite outer sides extending essentially parallel to one another;

a reaction zone formed between the outer sides of the press bands located opposite one another, wherein the material web is guided in the reaction zone;

a roller bed supported on said press frame adjacent at least one of said press bands so as to abut the side thereof opposite the parallel outer side thereof for applying pressure to the press band via said roller bed;

a shape compensating plate structure disposed in the press frame between said roller bed and said press frame, said plate structure comprising a cover plate on which said roller bed is mounted;

a base plate supported on said press frame in spaced relationship from said cover plate and connected to said cover plate at the edges thereof so as to enclose between said base and cover plates a chamber which is filled with a pressure-transmitting fluid, and a supporting plate disposed within said chamber for limiting deformation of said base and cover plates.

2. A double band press according to claim 1, wherein a rigid heat exchanging plate is arranged in the press frame adjacent said shape compensating plate opposite said press band.

3. A double band press according to claim 2, further comprising bore holes in the heat exchanging plate for conducting a fluid heat carrier through the bore holes.

4. A double band press according to claim 1, wherein said roller bed includes a roller carrier plate which is somewhat flexible.

5. The double band press according to claim 1, wherein angularly-shaped floating seals surround said roller bed so as to form a pressure chamber to which pressurized fluid may be admitted.

6. A double band press according to claim 1, wherein said base and cover plates of said shape compensating plate structure are joined at their edges by an elastic bellows structure of approximately semicircular cross-section.

7. A double band press according to claim 6, wherein the elastic bellows structure further comprises a number of individual rectangular metal plates bent to form the semicircular cross section, said plates being welded together at their longitudinal edges to form a plate packet.

8. A double band press according to claim 7, wherein the metal plates comprise one of a high-tensile spring steel and high-grade steel.

9. A double band press according to claim 7, wherein the elastic bellows structures are welded to the edges of said base and cover plates.

10. A double band press according to claim 6, wherein said supporting plate further comprises slightly beveled edge areas in the region of the inner curvature of the elastic bellows structure.

11. A double band press according to claim 10, wherein said beveled edge area comprises notches.

12. A double band press according to claim 1, wherein the supporting plate in said shape compensating plate structure is a metal plate extending substantially parallel to the base and cover plates.

13. A double band press according to claim 12, wherein said supporting plate consists of copper.

14. A double band press according to claim 1, wherein the fluid within said shape compensating plate structure is fluid metal.

15. A double band press according to claim 14, wherein the fluid metal is mercury.

16. A double band press according to claim 14, wherein the fluid metal comprises one of bismuth, lead, tin and cadmium alloy.

17. A double band press according to claim 14, wherein the fluid metal is a metal which is solid at room temperature and is liquid at the operating temperature used in the double band press.

18. A double band press according to claim 17, wherein the metal is tin.

19. A double band press according to claim 1, wherein the cover plate of the shape compensating plate structure includes a bore hole through which a fluid under pressure can be fed into the chamber.

20. A double band press according to claim 1, wherein said shape compensating plate structure comprises a plurality of individual strip-shaped separate regions disposed adjacent to one another in the transverse direction and extending in the longitudinal direction of said band press.

21. A shape compensating plate structure for disposition in a press comprising spaced base and cover plates connected to one another along their edges so as to define therebetween a closed chamber filled with pressure transmitting fluid and a supporting plate disposed in said chamber for limiting deformation of said base and cover plates, said base and cover plates of said shape compensating plate structure being joined at their edges by an elastic bellows of approximately semicircular cross-section.

22. A shape compensating plate structure according to claim 21, wherein the elastic bellows structure further comprises a number of individual rectangular metal plates bent to form the semicircular cross-section, said plates being welded together at their longitudinal edges to form a plate packet.

23. A shape compensating plate structure according to claim 21, wherein said supporting plate consists of copper for good heat transfer through said shape compensating plate structure.

24. A shape compensating plate structure according to claim 21, wherein said supporting plate further comprises slightly beveled edge areas in the region oft he inner curvature of the elastic bellows.

25. A shape compensating plate structure according to claim 24, wherein said beveled edge area comprises notches.

26. A shape compensating plate structure according to claim 21, wherein the fluid within said shape compensating plate structure is fluid metal.

27. A shape compensating plate structure according to claim 21, including a bore hole through which fluid under pressure can be fed into said closed chamber.

* * * * *